US010368635B2

(12) United States Patent
Reinhart et al.

(10) Patent No.: US 10,368,635 B2
(45) Date of Patent: Aug. 6, 2019

(54) MODULAR WORKSTATION

(71) Applicant: Creative Plastic Concepts, LLC, Sycamore, OH (US)

(72) Inventors: Nickolas Reinhart, Findlay, OH (US); Jacob H. Whitta, Findlay, OH (US)

(73) Assignee: Creative Plastic Concepts, LLC, Sycamore, OH (US)

( * ) Notice: Subject to any disclaimer, the term of this patent is extended or adjusted under 35 U.S.C. 154(b) by 0 days.

(21) Appl. No.: 15/901,409

(22) Filed: Feb. 21, 2018

(65) Prior Publication Data

US 2018/0235359 A1 Aug. 23, 2018

Related U.S. Application Data

(60) Provisional application No. 62/556,563, filed on Sep. 11, 2017, provisional application No. 62/461,980, filed on Feb. 22, 2017.

(51) Int. Cl.

| | |
|---|---|
| ***A47B 3/12*** | (2006.01) |
| ***A47B 3/00*** | (2006.01) |
| ***A47B 9/00*** | (2006.01) |
| ***A47B 87/00*** | (2006.01) |
| ***A47B 91/02*** | (2006.01) |

(52) U.S. Cl.

CPC ..... *A47B 3/12* (2013.01); *A47B 3/002* (2013.01); *A47B 9/00* (2013.01); *A47B 87/002* (2013.01); *A47B 91/024* (2013.01); *A47B 2003/006* (2013.01)

(58) Field of Classification Search

CPC ..... A47B 2003/045; A47B 2003/025; A47B 3/02; A47B 87/002; A47B 87/00

USPC ..... 108/64, 118, 119, 120

See application file for complete search history.

(56) References Cited

U.S. PATENT DOCUMENTS

| | | | | | |
|---|---|---|---|---|---|
| 318,298 | A * | 5/1885 | Roberts | 108/124 | |
| 432,425 | A * | 7/1890 | Moan | A47B 3/12 | 108/159 |
| 533,832 | A * | 2/1895 | Vandenberge | A47B 3/02 | 108/120 |
| 581,915 | A * | 5/1897 | Lord | A47B 3/00 | 108/174 |
| 1,652,942 | A * | 12/1927 | James | A47B 3/12 | 108/159 |
| 1,800,685 | A * | 4/1931 | Griffis | A47B 3/02 | 108/159.11 |
| 1,963,594 | A * | 6/1934 | Schwabe | A47B 31/04 | 108/159 |

(Continued)

*Primary Examiner* — Jose V Chen

(74) *Attorney, Agent, or Firm* — Jacob M. Ward; Ward Law Office LLC

(57) ABSTRACT

A workstation has a main body with at least two support structures pivotally displaced about a vertical axis, and a platform removably affixed to the support structures. The support structures may alternate between an opened position and a closed position, where the structures may be spaced apart in the opened position and may abut one another in the closed position. The support structures are rotatably connected to a central post. The platform is configured to also connect with the central post when the support structures are in a closed position. Additionally, the platform has a plurality of recesses that connect with various inserts, and allow multiple platforms to be joined together.

20 Claims, 12 Drawing Sheets

(56) References Cited

U.S. PATENT DOCUMENTS 2,000,915 A * 5/1935 Blake ..... A47B 3/06 108/118
2,400,162 A * 5/1946 Mulligan ..... E04B 1/10 108/64
2,669,117 A * 2/1954 Fuhrmann ..... E04G 21/00 108/101
3,669,031 A 6/1972 Cole
3,994,242 A * 11/1976 Damberg ..... A47B 47/021 108/64
4,296,524 A * 10/1981 Horholt ..... A63H 33/102 16/225
4,409,906 A * 10/1983 Alneng ..... A47B 87/002 108/185
4,700,986 A * 10/1987 Davis ..... A47B 3/14 108/64
D385,132 S 10/1997 Sagol
D448,200 S 9/2001 Sagol
6,286,824 B1 9/2001 Sagol
6,485,219 B1 * 11/2002 Beyer ..... A47B 87/008 403/338
7,174,838 B2 2/2007 Sagol et al.
D564,250 S 3/2008 Haimoff
D566,419 S 4/2008 Naim
7,415,933 B2 8/2008 Sagol
D620,286 S 7/2010 Carmon
D632,103 S 2/2011 Apelbaum
D656,342 S 3/2012 Blitzer
8,789,477 B2 * 7/2014 Jimenez Mangas ... A47B 13/02 108/115
D829,029 S * 9/2018 Reinhart ..... D6/684
10,064,482 B2 * 9/2018 Leafgren ..... A47B 23/00
2002/0105129 A1 * 8/2002 Levy ..... B25H 1/04 269/45
2003/0131766 A1 * 7/2003 Petlakh ..... E04F 15/02411 108/64
2005/0011421 A1 * 1/2005 Zhang ..... B25H 1/04 108/118
2015/0250300 A1 * 9/2015 Watts ..... A47B 3/0818 108/18
2015/0289647 A1 * 10/2015 Lin ..... A47B 87/002 108/64
2016/0051041 A1 * 2/2016 Choi ..... A47B 3/04 108/118

* cited by examiner

MODULAR WORKSTATION

CROSS-REFERENCE TO RELATED APPLICATIONS

This application claims the benefit of U.S. Provisional Application No. 62/556,563, filed on Sep. 11, 2017, and of U.S. Provisional Application No. 62/461,980, filed on Feb. 22, 2017. The entire disclosures of the above applications are hereby incorporated herein by reference.

FIELD

The present disclosure relates to a workstation and, more specifically, to a foldable modular workstation.

BACKGROUND

The statements in this section merely provide background information related to the present disclosure and may not constitute prior art.

When working on a construction site, it is often necessary to bring a table or surface onto which tools and other materials may be placed. A variety of worktables and work surfaces are known, and in many cases, are foldable or collapsible.

In one example, U.S. Pat. No. 3,669,031 to Cole discloses a collapsible workstation, which is designed for carrying power tools. In the opened position, the workstation of the Cole patent has a work surface with means for mounting a tool, such as a power saw, and legs containing wheels for portability of the workstation between different locations.

In another example, U.S. Pat. No. 7,415,933 to Sagol is directed to a foldable work table with two support structures that rotate around a central shaft. The work-plate of the Sagol patent may be attached to a post hole for compact transport and storage, when the two support structures are in the closed position.

These known tables are not especially modular, and thus present certain disadvantages in manufacturing and distribution. Moreover, they are not configured to connect with other workstations, or otherwise allow a user to customize a size of the work surface.

There is a continuing need for a workstation that is both modular and foldable. Desirably, the workstation is configured to interlock with other workstations in order for a user to customize a size of a work surface.

SUMMARY

In concordance with the instant disclosure, a workstation that is both modular and foldable, and which is configured to interlock with other workstations in order for a user to customize a size of a work surface, has been surprisingly discovered.

In one embodiment, a workstation includes a main body and a platform. The main body has at least two support structures that are rotatably connected to a central post. The support structures are rotatably connected at an upper connection joint and a lower connection joint of the central post. The central post defines a vertical axis of the main body. The support structures selectively alternate between an opened position and a closed position by rotating about the vertical access. The support structures also have free ends defining a top surface and a bottom surface. At least one of the support structures has a projection extending outwardly from the top surface, and a plurality of feet disposed on the bottom surface. The platform has an upper surface and a lower surface. The lower surface has elongated ridges that receive the top surface of the support structures when in the opened position. The upper surface of the platform defines the working surface of the workstation. The platform further has an aperture formed therethrough from the lower surface to the upper surface, the purpose of which is to receive the projection on at least one of the support structures when in the opened position. The projection and the aperture together ensuring a correct orientation and placement of the platform on the main body when assembled. The platform is also stowed within a storage area defined by the support structures when the support structures are in the closed position. For this purpose, the platform has at least one clamp on the lower surface that interlocks with the central post.

In other embodiments, the platform has a sidewall disposed around a periphery of the platform. The sidewall may have an inner surface with a bead that is configured to contact an interference bump located on an outer surface at least one of the support structures adjacent to the free end of the at least one of the support structures. The upper surface and the sidewall of the platform may have a recess formed therein for receiving at least one insert connector to secure the platform to another platform. The recess may be substantially T-shaped, and the insert connector may be substantially H-shaped and configured to be received by the T-shaped recess of the platform, for example.

The lower surface of the platform may also have an insert holder configured to store the insert connector when not being used to secure the platform to the another platform. The insert portion of the insert holder may have at least two raised portions configured to receive the insert connector. The insert holder further have a clip configured to secure a center portion of the insert connector within the holder.

The plurality of feet may also include at least one foot with an adjuster configured to selectively alter a height or level of the platform relative to a ground or floor surface. For example, where the support structures are hollow, the foot with the adjuster may be provided by a first modular insert. Similarly, the projection may be provided by a second modular insert. The first modular insert may be received by one of the free ends at the bottom surface of one of the support structures. The first modular insert may have a plurality of windows that are defined by a plurality of angled walls. The walls are configured to receive a helical thread on a shaft of the adjuster and to advance the shaft through the modular insert as the adjuster is selectively rotated. The second modular insert is received by one of the free ends at the top surface of the support structures.

The shapes of the projections and the inserts may be selected so as to ensure a correct origination of the platform relative to the main body upon assembly. For example, a round or circular project and insert may not be suitable for this purpose. It has been found that, where each of the projection of the support structures and the aperture of the platform is hexagonal in shape, confidence in the correct orientation for assembly is readily attached.

In yet another embodiment, a kit having the main body with the at least two support structures may be provided together with a separate platform for subsequent assembly of the workstation. A first insert defining one of the feet may be separately provided in the kit for disposal in a hollow portion of the bottom surface of the support structure. A second insert defining the projection may also be separately provided in the kit for disposal in a hollow portion of the top surface of the support structure. Other types of modular inserts including connectors are also contemplated and may be provided within the kit, as desired.

In a further embodiment, a method for providing an enlarged workspace is also disclosed. The method includes a step of providing two of the workstations. The upper surface and the sidewall of the platform of each of the workstations has a recess formed therein for receiving at least one insert connector to secure the platform to another platform. The two workstations are then placed adjacent to each other, wherein the recess of one of the workstations is adjacent to the recess of the other of the workstations. The insert connector is then inserted into each of the recesses. The two workstations are thereby secured to each other and together form the enlarged work surface.

DRAWING

The above, as well as other advantages of the present disclosure, will become clear to those skilled in the art from the following detailed description, particularly when considered in the light of the drawings described hereafter.

DETAILED DESCRIPTION

The following detailed description and appended drawings describe and illustrate various embodiments of the invention. The description and drawings serve to enable one skilled in the art to make and use the invention, and are not intended to limit the scope of the invention in any manner.

FIGS. 1-11 illustrate a foldable workstation 2 according to one embodiment of the present disclosure. The workstation 2 has a main body defined by at least two support structures 4A, 4B. The at least two support structures 4A, 4B support a platform 6 in operation. The support structures 4A, 4B may be substantially rectangular frames, for example, although other shapes and sizes are contemplated. The platform 6 is removably connected to the support structures 4A, 4B, and each support structure 4A, 4B is pivotably movable about a vertical axis defined by a central post 8, which may be arranged centrally relative to the frames of the support structures 4A, 4B as shown in FIGS. 1-3, 5-6A, and 7-8.

In certain embodiments, the support structures 4A, 4B and the platform 6 may be injection molded with a thermoplastic material such as polypropylene, polyethylene, acrylonitrile butadiene styrene, polycarbonate, high impact polystyrene, or polyamide, as non-limiting examples. In other embodiments, the support structures 4A, 4B, platform 6, and central post 8 may be made from a variety of materials, including but not limited to plastic, metal, wood or any other suitable material chosen by a skilled artisan. One of ordinary skill in the art may selected other suitable manufacturing methods and materials for the workstation 2 within the scope of the disclosure.

Figure 2:
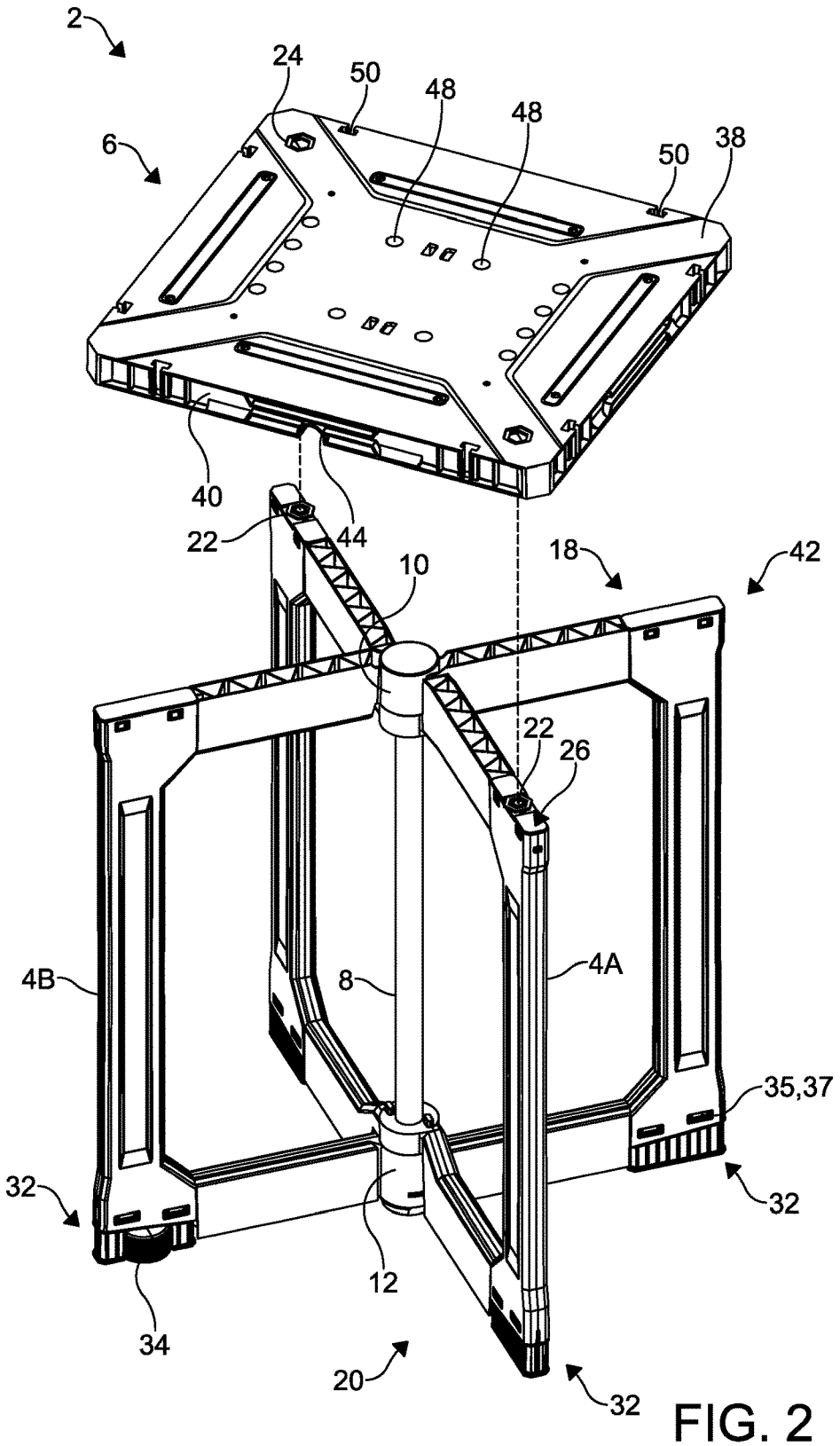
FIG. 2 is an exploded top perspective view of the workstation shown in FIG. 1.

The support structures 4A, 4B may alternate between an opened position, when the workstation 2 is ready to be used, and a closed position, when the workstation 2 is stowed for transport or storage. In the opened position, the support structures 4A, 4B are folded outwardly until support structure 4A is oriented transverse to support structure 4B, as shown in FIG. 2. In the closed position, the support structures 4A, 4B are substantially parallel to each other. In particular, major surfaces of the support structures 4A, 4B may abut each other when the support structures 4A, 4B are in the closed position.

Figure 5:
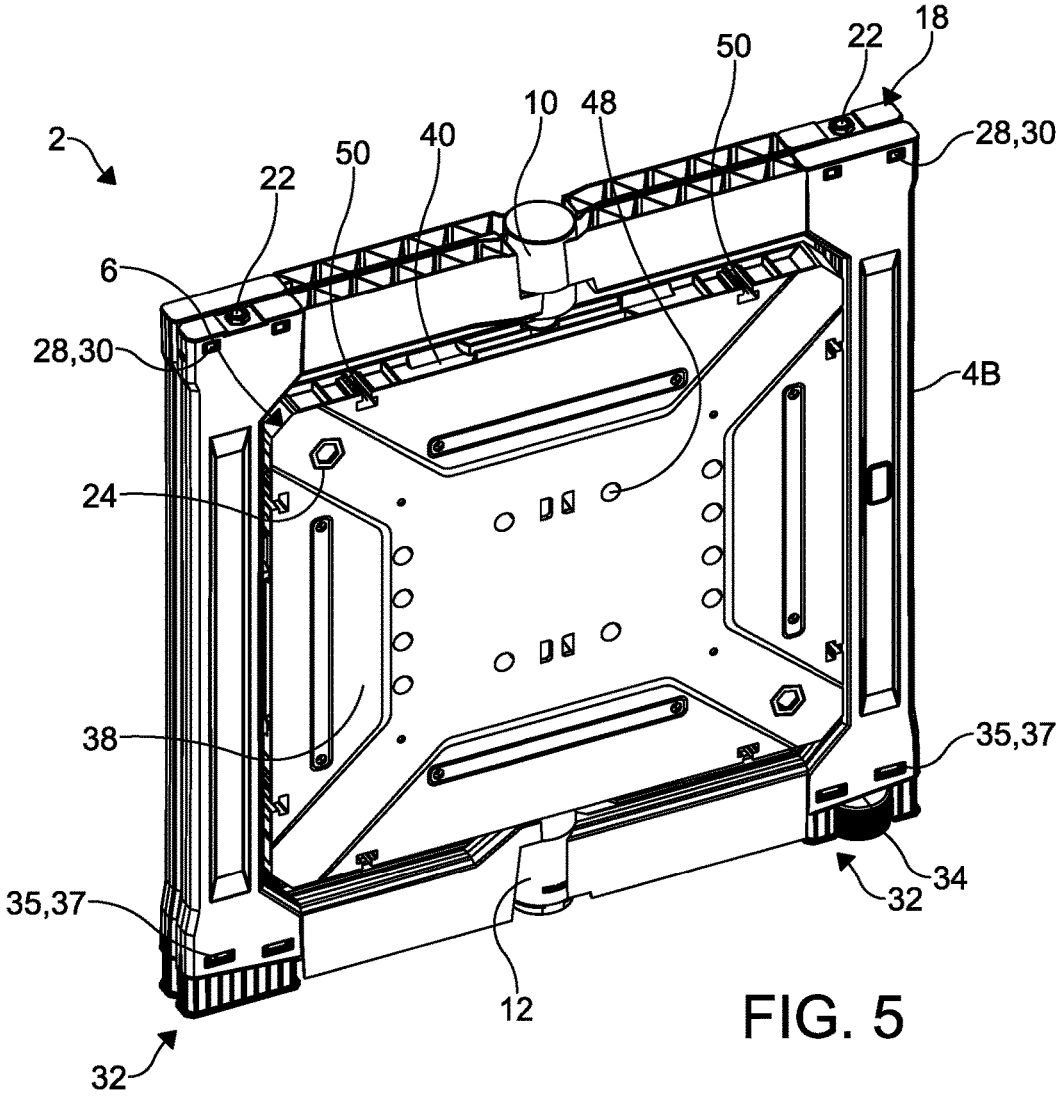
FIG. 5 is a front perspective view of the workstation show in FIG. 1 in a closed position, with a platform stowed between support structures of the workstation.

The entire outer perimeter of the platform 6 is also configured to fit within a storage area defined by the support structures 4A, 4B when in a closed position, as shown in FIG. 5. For example, the support structures 4A, 4B are illustrated in FIGS. 1-3, 5-6A, and 7-8 as substantially rectangular, and may therefore define a substantially rectangular storage area when in the closed position. However, it should be appreciated that the structural supports 4A, 4B may be any other suitable shape chosen by a skilled artisan, as desired.

Figure 3:
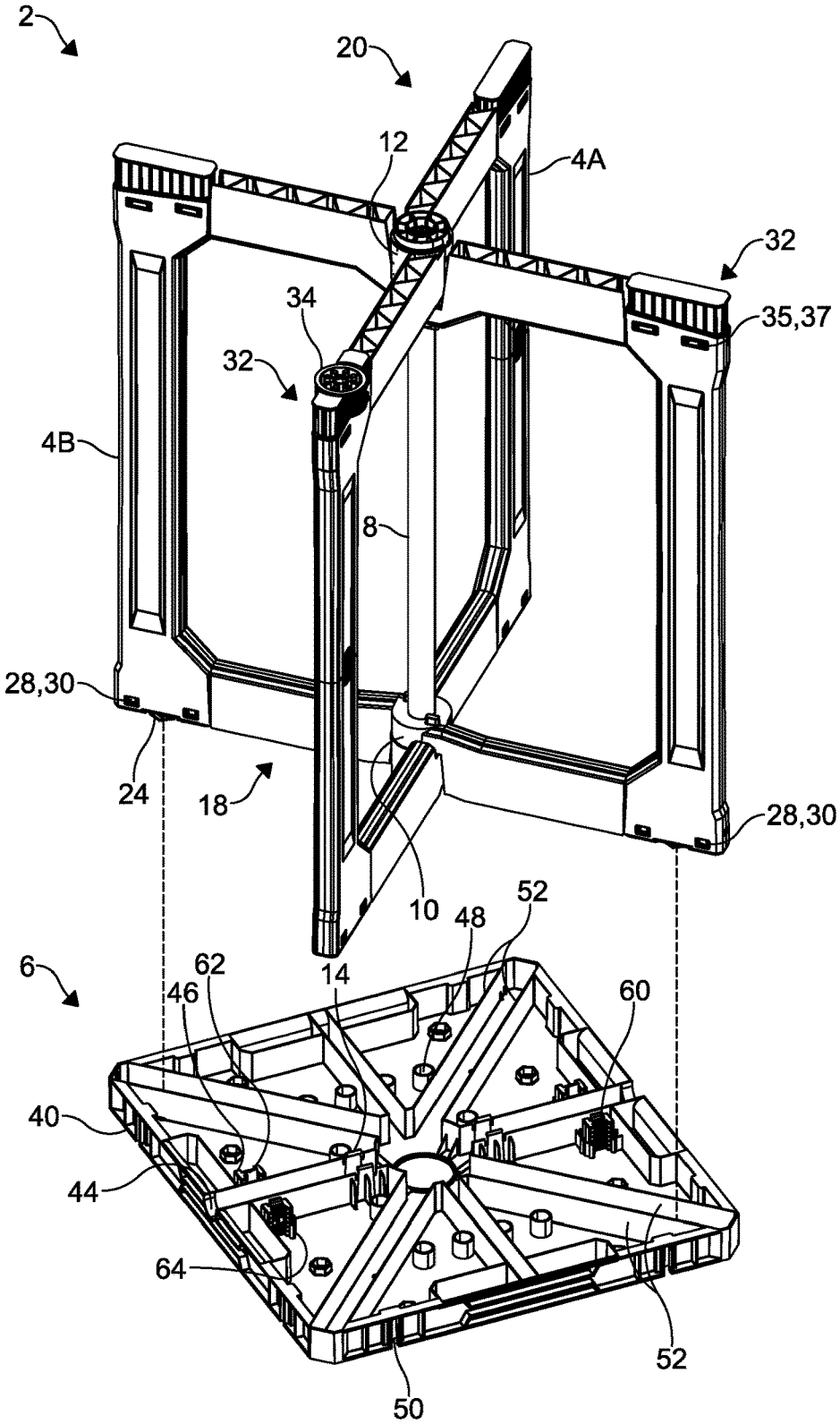
FIG. 3 is an exploded bottom perspective view of the workstation shown in FIG. 1.

As shown in FIGS. 2 and 3, the support structures 4A, 4B may be rotatably connected to the central post 8, which defines the vertical axis, at a top connection joint 10 and a bottom connection joint 12. The top and bottom connection joints 10, 12 may be collars that receive the central post 8, for example, and permit the support structures 4A, 4B to freely rotate. The collars may also be provided with stop features that militate against an over-rotation of the supports structures 4A, 4B relative to each other when moving between the opened position and the closed position. The central post 8 stabilizes the support structures 4A, 4B and the platform 6 of the workstation 2 in operation.

Figure 6A:
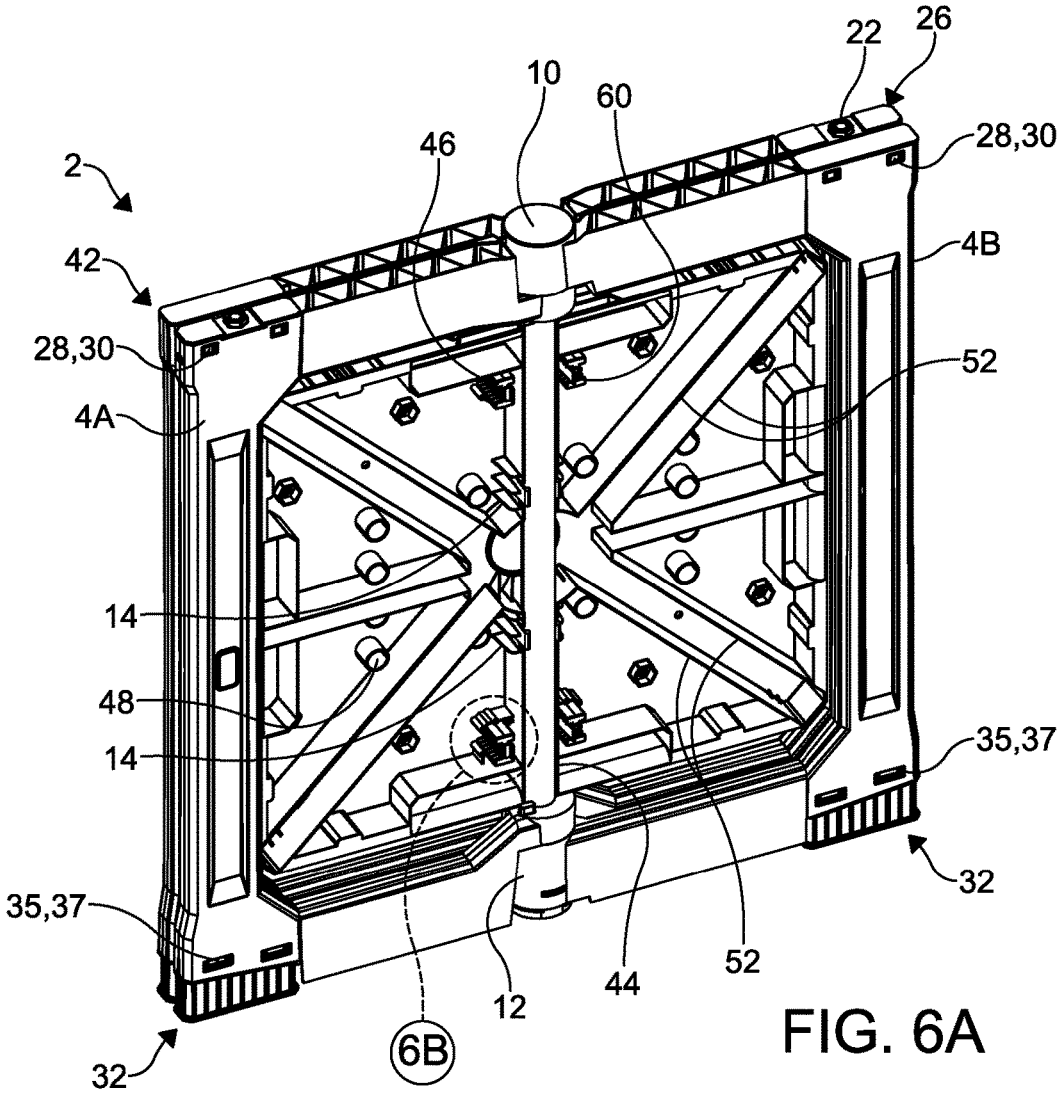
FIG. 6A is a rear perspective view of the workstation shown in FIG. 1 in a closed position, with the platform stowed between support structures of the workstation.

When the support structures 4A, 4B are collapsed, as also illustrated in FIG. 6A, the platform 6 has a pair of clamps 14 that are configured to interlock with the central post 8. The clamps 14 thereby may be used to secure the platform 6 within the area defined by the support structures 4A, 4B when in the closed position. Although the platform 6 is shown using the clamps 14, the platform 6 may connect to the central post 8 by a strap, snap, hook and loop fastener, or any other suitable means chosen by one skilled in the art, as desired.

As shown in FIGS. 2-3, when the support structures 4A, 4B are rotated to the opened position, the support structures 4A, 4B may be rotated about the vertical axis until support structure 4A contacts support structure 4B at the upper connection joint 10 and the lower connection joint 12. This results in support structure 4A being oriented transverse to support structure 4B in the opened position. The transverse orientation of the support structures 4A,4B in the opened position create a substantially cross-shaped top surface 18 and a cross-shaped bottom surface 20, as shown in FIGS. 2 and 3.

Figure 1:
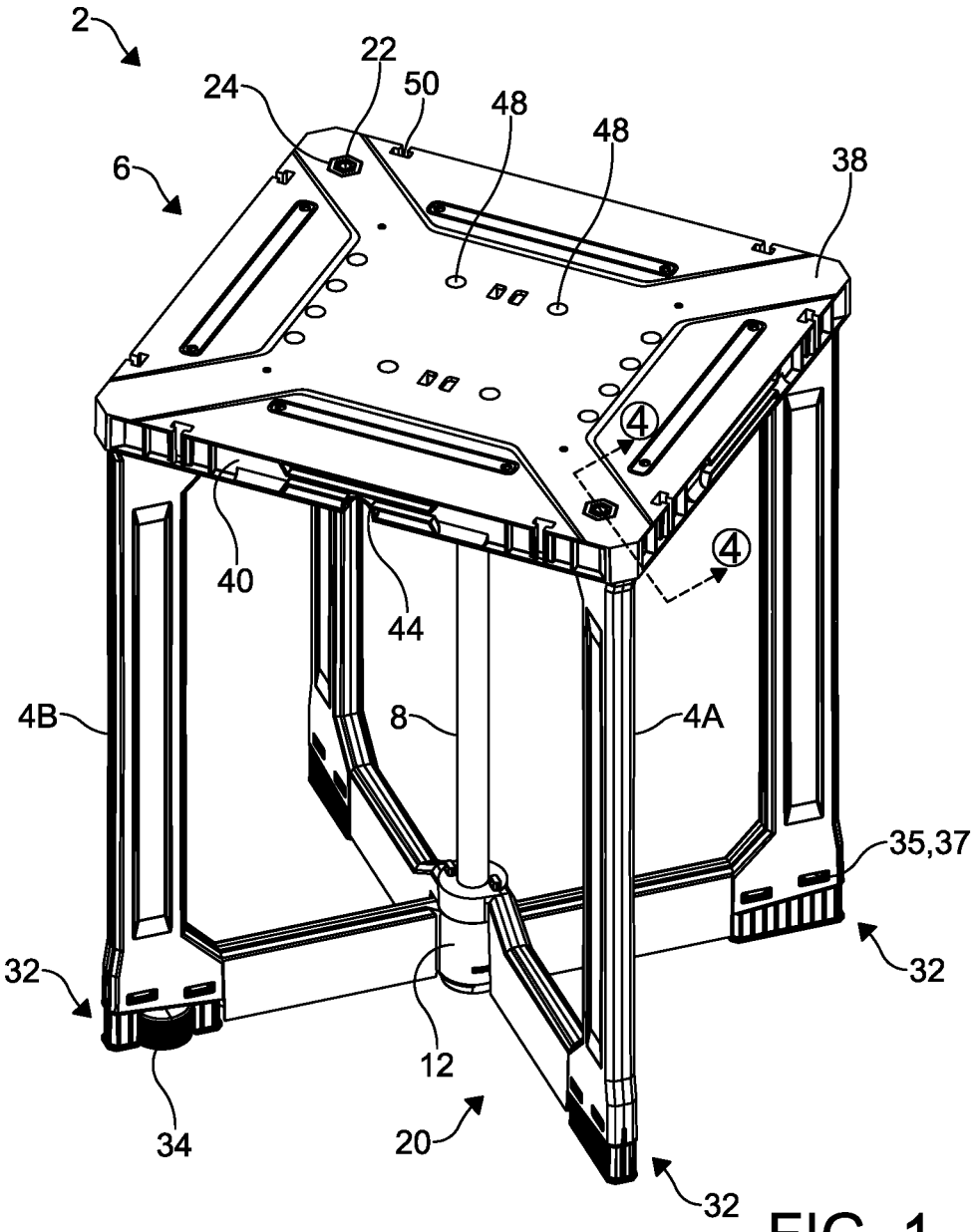
FIG. 1 is a top perspective view of a workstation according to one embodiment of the present disclosure, the workstation shown in an opened position.

The cross-shaped top surface 18 of the support structures 4A, 4B is configured to removably connect with and support the platform 6, as shown in FIG. 1. In particular embodiments, the top surface 18 of the support structure 4A has a projection 22 that is configured to fit within an aperture 24 on the platform 6. The projections 22 may be located on a single support structure 4A, for example. In this manner, the projection 22 and aperture 24 may advantageously serve as a navigation tool to assist the user in assembly of the platform 6 with the support structures 4A, 4B to form the workstation 2. As a navigation tool, the projection 22 and aperture 24 may also be provided with a bright color to help the user properly position the platform 6 on the support structures 4A, 4B.

Figure 10:
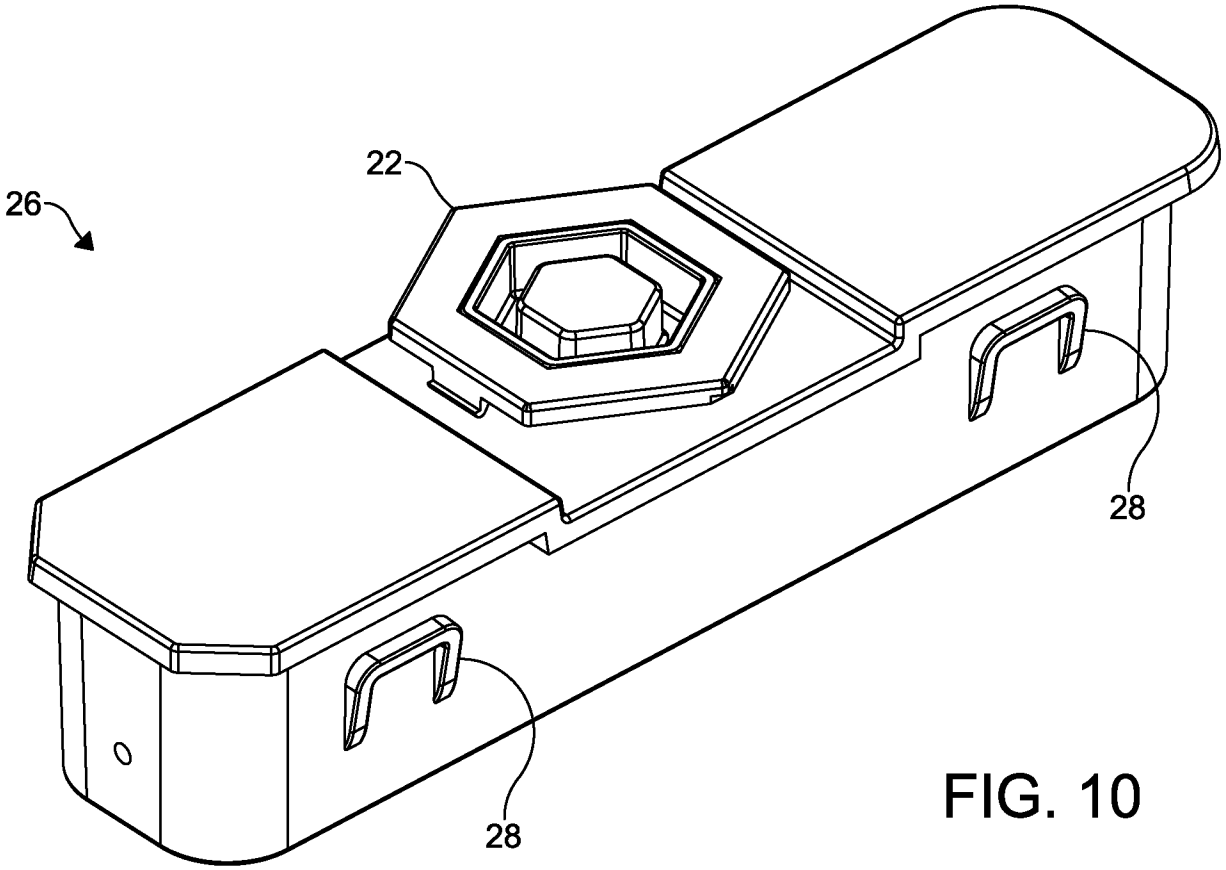
FIG. 10 is a top perspective view of a modular insert of the workstation shown in FIG. 1, the modular insert having a hexagonal projection that is configured to connect with a top surface of a platform of the workstation.

In certain embodiments, as shown in FIG. 10, the support structures 4A, 4B may be hollow, and the projection 22 may be formed in a second modular insert 26, which is configured to be both inserted into the free end of the hollow support structure 4A, 4B and removably secured in the top surface 18 of the support structures 4A, 4B. The projection 22 may also be hexagonally shaped, and is shown in FIG. 10 having both an outer hexagon and an inner hexagon.

To secure the second modular insert 26 in the top surface 18 of the support structures 4A, 4B, the second modular insert 26 may have at least two protrusions 28 on a side surface thereof. The protrusions 28 are configured to be recited by a corresponding set of at least two openings 30 formed in the support structures 4A, 4B. In this manner the second modular inserts 26 may be securely held at the top of the support structures 4A, 4B for mating with the platform 6.

Figure 11:
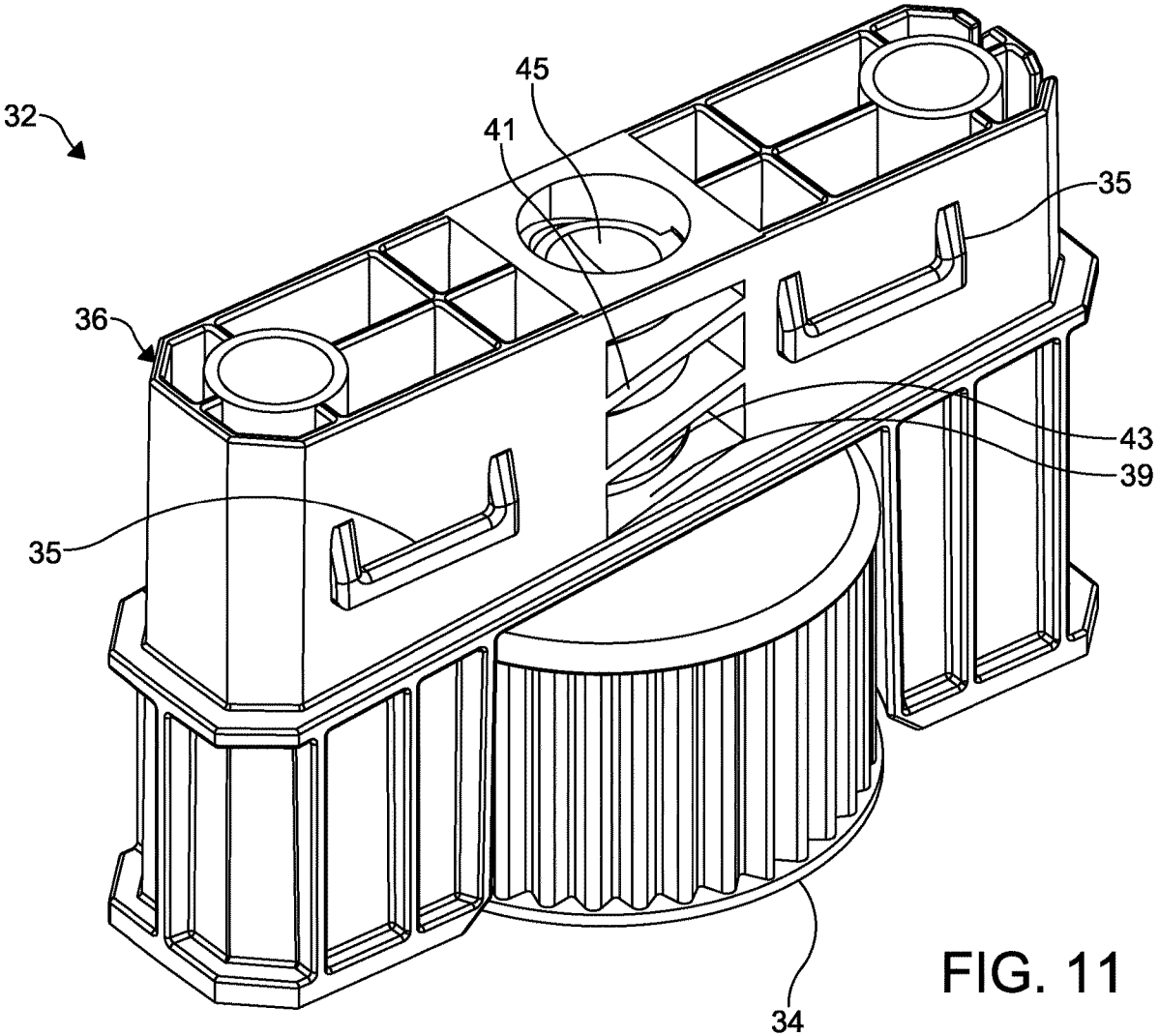
FIG. 11 is a top perspective view of a modular foot that is configured to connect with a bottom surface of structural supports of the workstation shown in FIG. 1.

As also shown in FIG. 3, the cross-shaped bottom surface 20 of support structures 4A, 4B may have a plurality of feet 32 that are configured to contact a ground or floor surface. The feet 32 raise the support structures 4A, 4B and bottom connection joint 12 above the ground or floor surface. In a particular embodiment, there may a pair of feet 32 for each support structure 4A, 4B. At least one of the feet 32 may also have an adjuster 34 that can change the height of the workstation 2, for example, as shown in FIG. 11. Although FIGS. 1-11 illustrate an adjuster 34 on only one foot 32, each foot 32 of the workstation 2 may also be provided with the adjuster 34. It should be appreciated that the adjuster 34 may alter the height of the workstation 2 using a screw mechanism or any other suitable means, as desired.

As shown in FIG. 11, the feet 32 may be first modular inserts 36 that are configured to be removably inserted into the bottom free end of the hollow support structures 4A, 4B. The first modular insert 36 may have at least two protrusions 35 that are configured to be received by a corresponding set of at least two openings 37 formed in the bottom of the support structures 4A, 4B.

The main body of the first modular insert 36 may also have windows 39 that are defined by angled walls 41. The angled walls 41 are configured to receive and abut a helical thread 43 on a shaft 45 attached to the adjuster 34. In operation, rotating the adjuster 34 turns the helical thread 43 disposed in the windows 39, which raises or lowers the adjuster 34 in relation to the first modular insert 36 depending on the direction of rotation.

With renewed reference to FIG. 2, the platform 6 has an upper surface 38. A sidewall 40 is oriented transverse to the upper surface 38 of the platform 6, and may be arranged around an entire periphery of the platform 6. In particular, the sidewall 40 is configured to cover or envelop free ends 42 of the support structures 4A, 4B, and thereby permit the platform 6 to operate as a working surface for an end user.

The sidewall 40 may also have a recess 44 that is configured to partly surround the central post 8 when the platform 6 is disposed within the storage area defined by the support structures 4A, 4B in the closed position. The recess 44 allows the platform 6 to remain substantially flush with the support structures 4A, 4B when the platform 6 is clamped to the central post 8, as shown in FIGS. 5 and 6.

With reference to FIGS. 1 and 5, the upper surface 38 of the platform 6 also has a plurality of apertures 48. The apertures 48 are configured to receive various inserts. The inserts may be any number of objects including, but not limited to, a clamp, a board holder, and a saw. In exemplary embodiments, the apertures 48 may be circular or hexagonal in shape. Other suitable shapes for the apertures 48 are contemplated and may also be employed within the scope of the disclosure.

Figure 8:
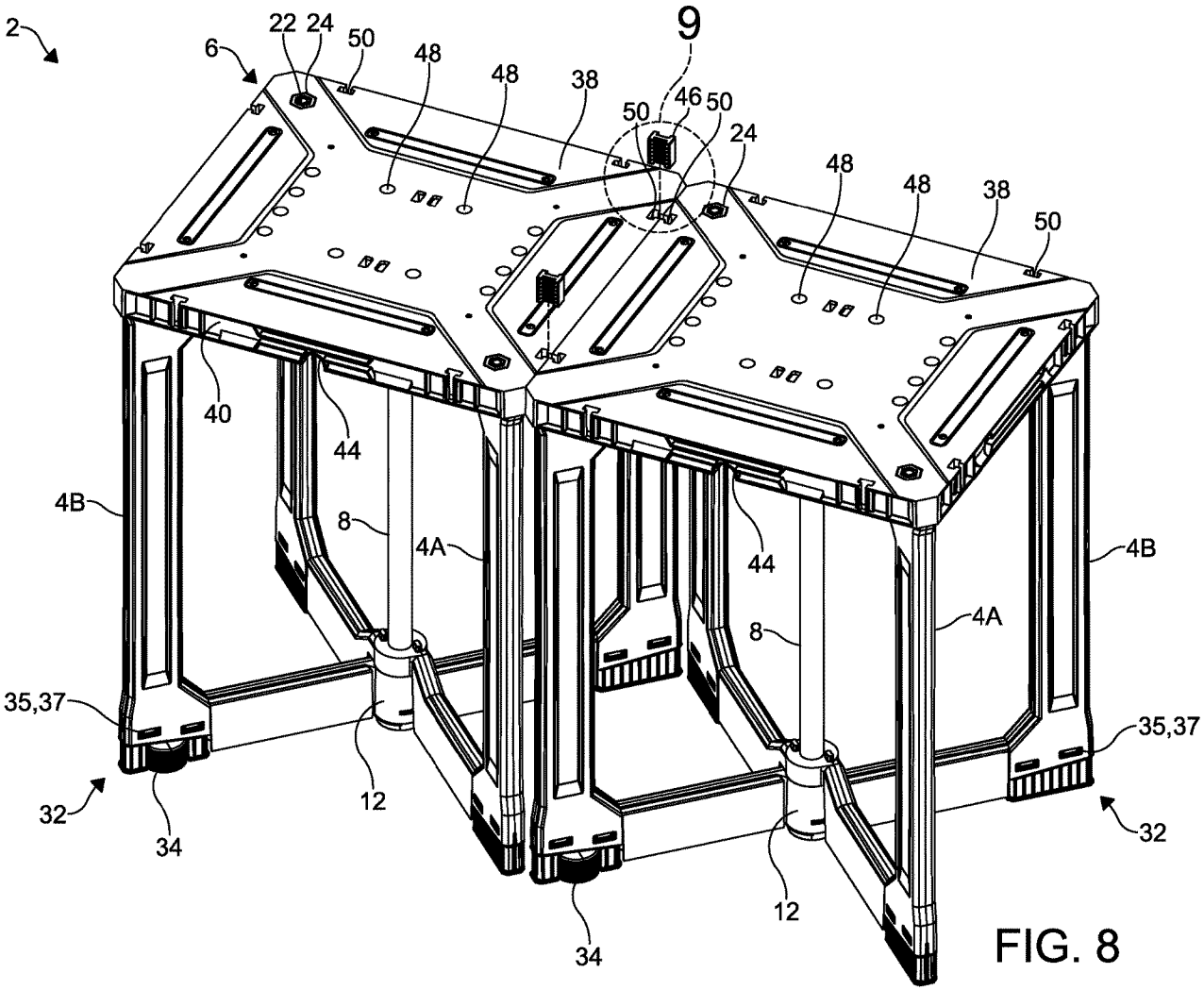
FIG. 8 is a top perspective view of two of the workstations shown in FIG. 1, with the workstations shown joined together, with a pair of H-shaped connectors shown exploded from T-shaped recesses of the workstations.
Figure 9:
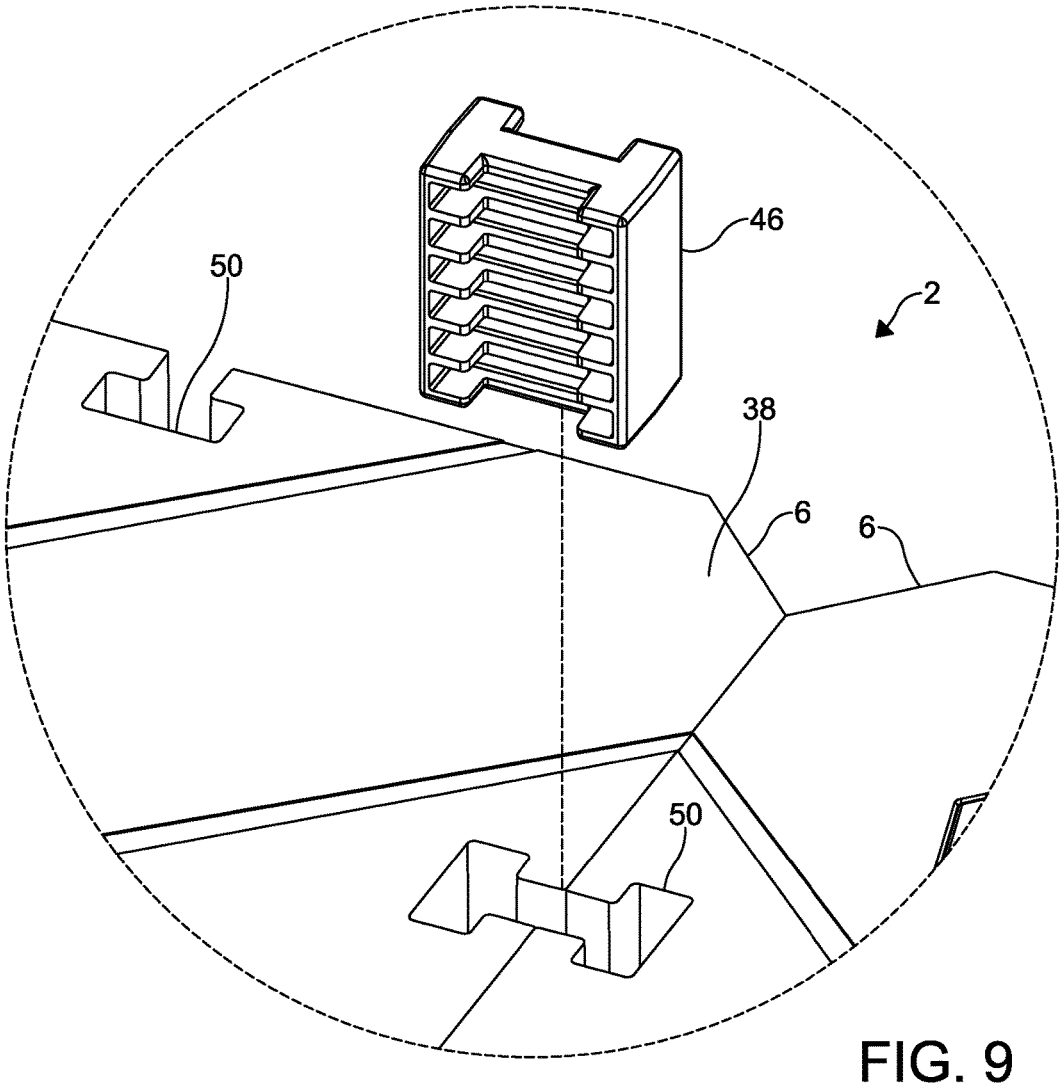
FIG. 9 is an enlarged top perspective view of one of the H-shaped connectors taken at callout 9 in FIG. 8.

Advantageously, the platform 6 may further have T-shaped recesses 50. The T-shaped recesses 50 are configured to receive an I- or H-shaped connector 46 (also called a "dog-bone" shape) for securing the platform 6 of one workstation 2 to the platform 6 of another workstation 2, as shown in FIGS. 8 and 9. Specifically, there may be two T-shaped apertures 50 per each side of the platform 6. In this manner, the H-shaped connectors 46 may be used to form a work surface of a desired size.

As illustrated in FIGS. 3 and 6, the underside or lower surface of the platform 6 may have a plurality of elongated ridges 52 that are configured to receive and envelop the top surface 18 of the support structures 4A, 4B, and the upper connection joint 6, when the support structures 4A, 4B are in an opened position. The elongated ridge 52 may also be integrally molded to the sidewall 40, which envelops the free end 42 of the support structures 4A, 4B.

Figure 4:
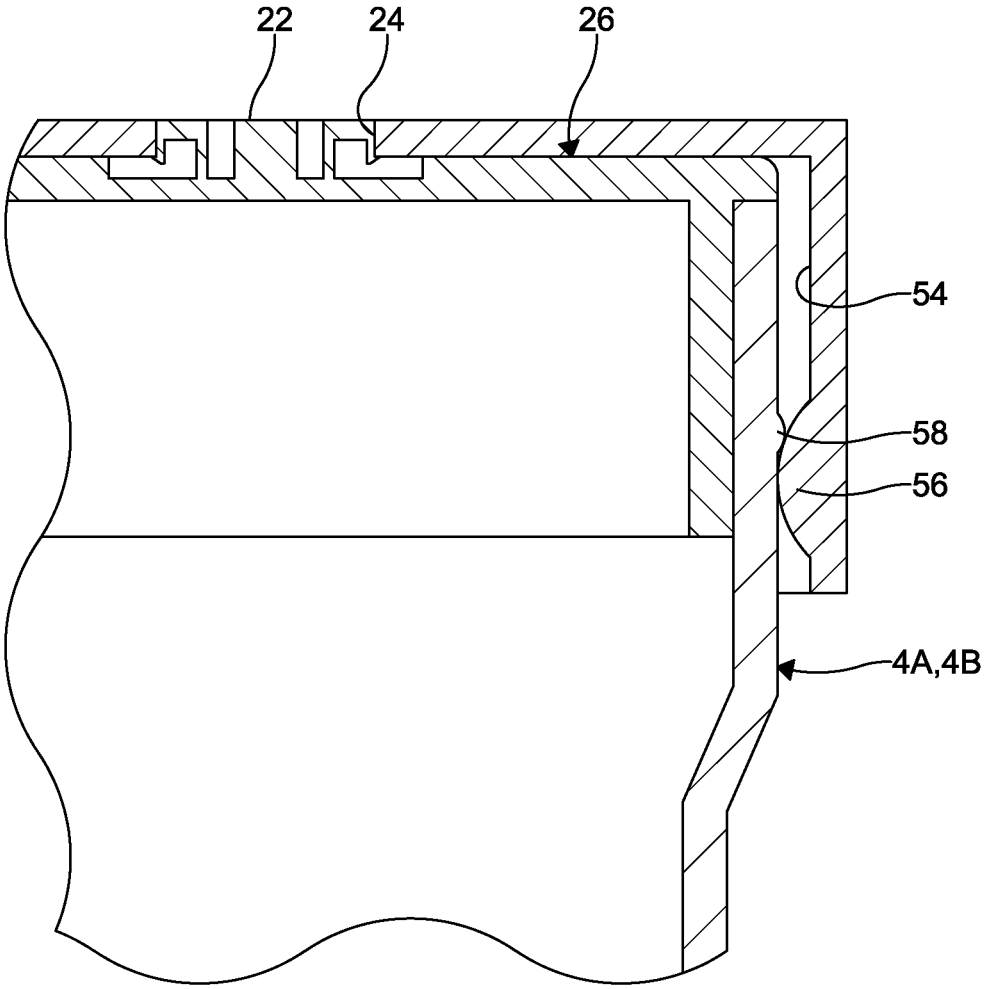
FIG. 4 is an enlarged, cross-sectional, fragmentary side elevational view of a platform of the workstation taken at section line 4-4 in FIG. 1.

In certain examples, as shown in FIG. 4, the sidewall 40 may have an inner surface 54 with a bead 56 that is configured to abut an interference bump 58 on the free end 42 of the support structures 4A, 4B. In certain embodiments, the bead 56 on the inner surface 54 may be on all corners of the sidewall 40, and the interference bump 58 may be on all free ends 42 of the support structures 4A, 4B. However, any orientation or arrangement of beads 56 and interference bumps 58 may be chosen by a skilled artisan, as desired.

Figure 6B:
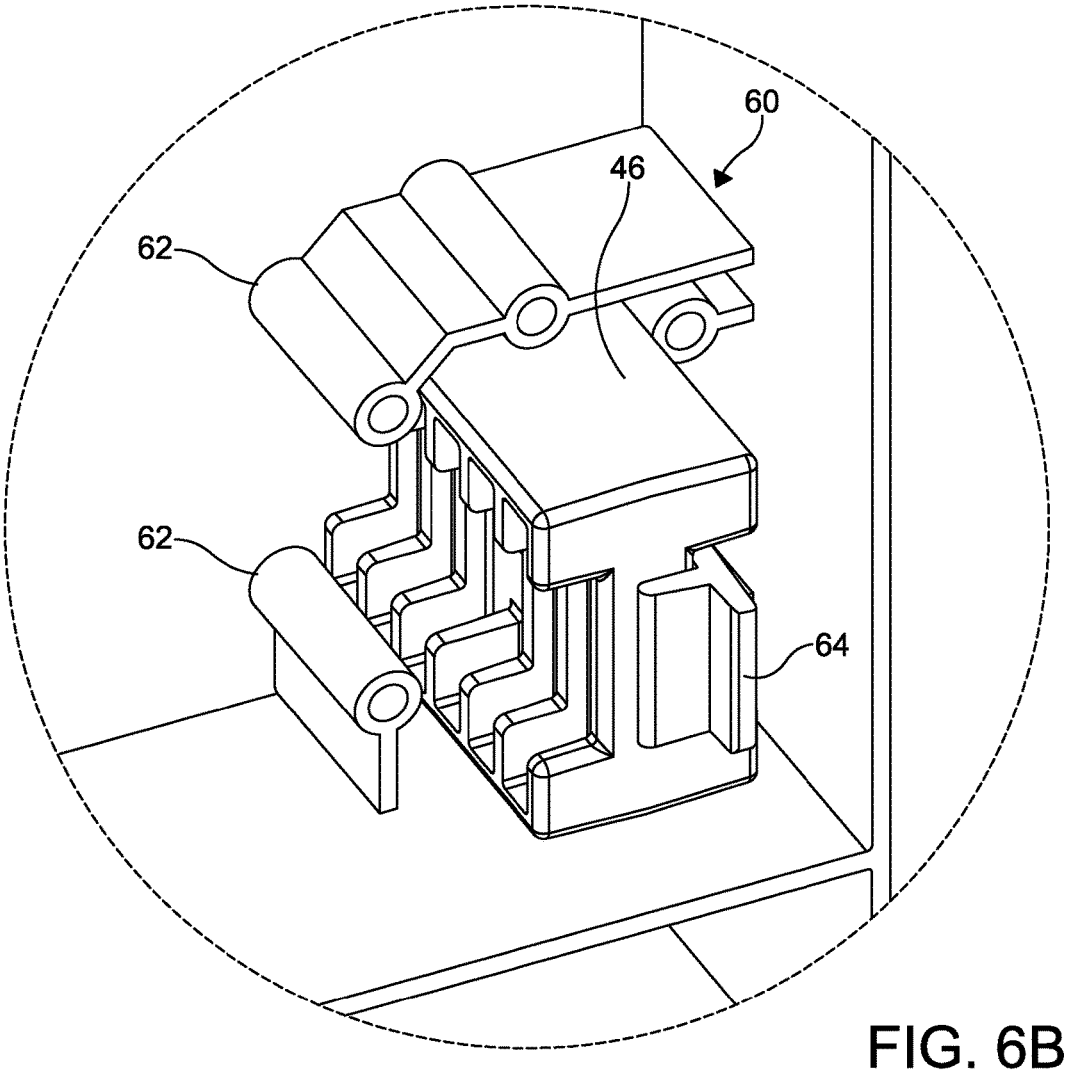
FIG. 6B is an enlarged perspective view of the workstation taken at callout 6B in FIG. 6A, and further showing an H-shaped connector storage clip on an underside of a platform of the workstation.
Figure 7:
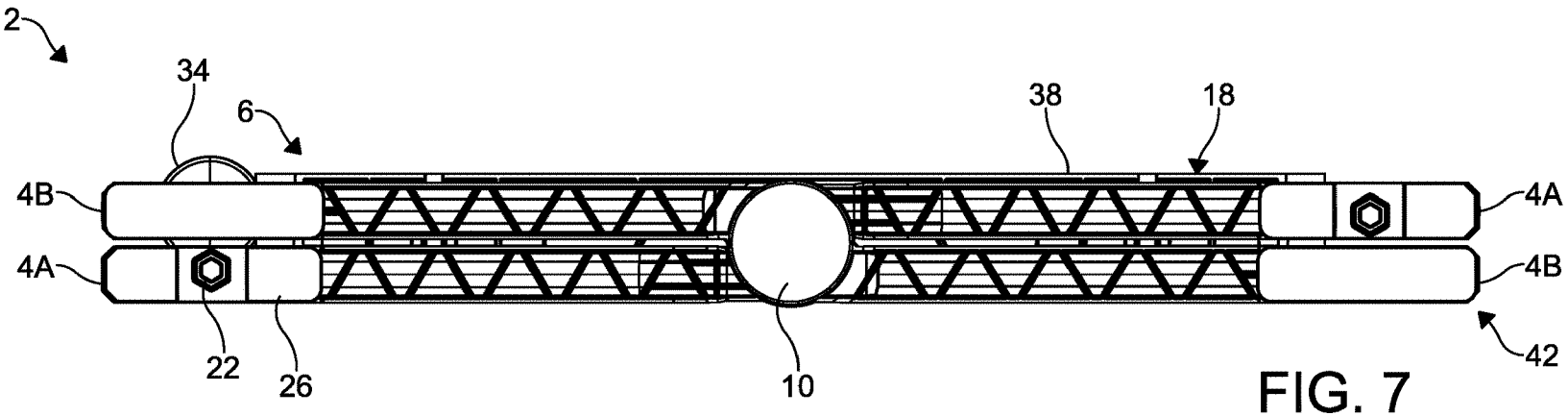
FIG. 7 is a top plan view of support structures of the workstation shown in FIG. 1, the support structures shown in a closed position.

As shown in FIGS. 6A and 6B, the underside of the platform 6 may also have storage holders 60 that are configured to securely store the H-shaped connectors 46 when not being used to connect multiple workstations 2. The storage holders 60 may have raised portions 62 that are disposed adjacent a least two sides of the connectors 46, The storage holders 60 also may have a clip 64. The clip 64 is configured to secure a thin center portion of the H-shaped connector 46, while the raised portions 62 secure the ends of the H-shaped connector 46. One of ordinary skill in the art may also select other suitable configurations for storage of the connectors 46 within the scope of the present disclosure.

With renewed reference to FIGS. 2 and 4, the projection 22 may be located adjacent to the free end 42 of the support structure 4A, 4B. It should be appreciated that the projection 22 interlocking with the aperture 24 on the platform 6, combined with a friction fit caused by an interference bump 58 on an outer surface of the support structure 4A, 4B abutting a bead 56 on the inner surface 54 of the sidewall 40, may advantageously function to create multiple fastening points between the platform 6 and the structural supports 4A, 4B. These multiple fastening points increase the stability of the platform 6 when connected to the support structures 4A, 4B upon assembly of the workstation 2 in the opened position.

As illustrated in FIG. 8, the platform 6 is also configured to interlock with platforms 6 on adjacent workstations 2. Each platform 6 is able to connect to other platforms by inserting the H-shaped connector 46 into corresponding T-shaped recesses 50 on adjacent platforms 6. The recesses 50 are oriented in such a way to create a stable work surface between the combined platforms 6. In particular embodiments, the connectors are H-shaped connectors 46, which are configured to fit within each T-shaped recess 50. The platforms 6 may be interconnected to form a multitude of shapes, such as a rectangle, a U-shape, or any other shape to be chosen by the end user for the desired work surface.

In other embodiments (not shown), the support structures may include a pair of fixed legs and at least one pair of foldable legs. Specifically, there may be two fixed legs and four foldable legs used to support the platform. Each of the fixed legs and the foldable legs may further have height adjusters disposed at the ends thereof, and which support the legs, in an upright position. The height adjusters may threadedly engage the ends of the legs, for example, and permit for a height adjustment of the legs by selective rotation of the height adjusters. One of ordinary skill in the art may select other suitable numbers of legs, as well as other suitable types of height adjusters, as desired.

The fixed legs may also be affixed to the central post with crossbeams (not shown). It should be appreciated that, being fixed in place, the crossbeams are not rotatable relative to the central post. As a non-limiting example, the fixed legs, the central post, and the crossbeams may be integrally formed as a single, unitary injection-molded plastic body. Other means for affixing the crossbeams to the central post may also be used within the scope of the disclosure.

Advantageously, the workstation 2 of the present disclosure is both modular and foldable as described hereinabove. The workstation 2 is also advantageously configured to interlock with other workstations 2 in order for the end user to customize a size of the work surface. It should also be appreciated that the above-mentioned modular components may be provides separately, in the form of a kit, for example, for subsequent assembly to provide the workstation 2 of the present disclosure.

While certain representative embodiments and details have been shown for purposes of illustrating the invention, it will be apparent to those skilled in the art that various changes may be made without departing from the scope of the disclosure, which is further described in the following appended claims.

What is claimed is:

1. A workstation, comprising:

a main body including at least two support structures rotatably connected to a central post at an upper connection joint and a lower connection joint of the central post, the central post defining a vertical axis of the main body, the support structures alternate between an opened position and a closed position by rotating about the vertical axis, the support structures having free ends defining a top surface and a bottom surface, at least one of the support structures having a projection extending outwardly from the top surface, and a plurality of feet disposed on the bottom surface; and a platform having an upper surface and a lower surface, the lower surface having elongated ridges that receive the top surface of the support structures when in the opened position, the platform further having an aperture formed therethrough from the lower surface to the upper surface to receive the projection on at least one of the support structures when in the opened position, the projection and the aperture each configured to ensure a correct orientation and placement of the platform on the main body, wherein the platform is stowed within a storage area defined by the support structures when the support structures are in the closed position, the platform having at least one clamp on the lower surface that is configured to interlock with the central post.

2. The workstation of claim 1, wherein the platform has a sidewall disposed around a periphery of the platform.

3. The workstation of claim 2, wherein the sidewall has an inner surface with a bead that is configured to contact an interference bump located on an outer surface at least one of the support structures adjacent to the free end of the at least one of the support structures.

4. The workstation of claim 2, wherein the upper surface and the sidewall of the platform has a recess formed therein for receiving at least one insert connector to secure the platform to another platform.

5. The workstation of claim 4, wherein the recess is T-shaped.

6. The workstation of claim 5, wherein the insert connector is H-shaped and a T-shaped portion of the insert connector is configured to be received by the T-shaped recess of the platform.

7. The workstation of claim 4, wherein the lower surface of the platform has an insert holder configured to store the insert connector when not being used to secure the platform to the another platform.

8. The workstation of claim 7, wherein an insert portion of the insert holder has at least two raised portions configured to receive the insert connector.

9. The workstation of claim 8, wherein the insert holder further has a clip configured to secure a center portion of the insert connector within the holder.

10. The workstation of claim 1, wherein the plurality of feet includes at least one foot with an adjuster configured to selectively alter a height or level of the platform.

11. The workstation of claim 10, wherein the support structures are hollow, and the foot with the adjuster is provided by a first modular insert.

12. The workstation of claim 11, wherein the first modular insert is received by one of the free ends at the bottom surface of one of the support structures.

13. The workstation of claim 12, wherein the first modular insert has a plurality of windows that are defined by a plurality of angled walls, wherein the walls are configured to receive a helical thread on a shaft of the adjuster and to advance the shaft through the modular insert as the adjuster is selectively rotated.

14. The workstation of claim 1, wherein the support structures are hollow, and the projection is provided by a second modular insert.

15. The workstation of claim 14, wherein the second modular insert is received by one of the free ends at the top surface of one of the support structures.

16. The workstation of claim 1, wherein each of the projection of the support structures and the aperture of the platform is hexagonal in shape.

17. A kit for a workstation, comprising:

a main body including at least two support structures rotatably connected to a central post at an upper connection joint and a lower connection joint of the central post, the central post defining a vertical axis of the main body, the support structures configured to alternate between an opened position and a closed position by rotating about the vertical axis, the support structures having free ends defining a top surface and a bottom surface, at least one of the support structures having a projection extending outwardly from the top surface, and a plurality of feet disposed on the bottom surface; and a platform having an upper surface and a lower surface, the lower surface having elongated ridges that are configured to receive the top surface of the support structures when in the opened position, the platform further having an aperture formed therethrough from the lower surface to the upper surface and configured to receive the projection on at least one of the support structures when in the opened position, the projection and the aperture each configured to ensure a correct orientation and placement of the platform on the main body, wherein the platform is also configured to be stowed within a storage area defined by the support structures when the support structures are in the closed position, the platform having at least one clamp on the lower surface that is configured to interlock with the central post.

18. The kit of claim 17, further comprising a first modular insert defining a foot with an adjuster, and configured to be received by one of the free ends at the bottom surface of one of the support structures.

19. The kit of claim 17, further comprising a second modular insert defining the projection, and configured to be s received by one of the free ends at the top surface of one of the support structures.

20. A method of interlocking multiple workstations comprising:

providing two workstations, each workstation having a main body including at least two support structures rotatably connected to a central post at an upper connection joint and a lower connection joint of the central post, the central post defining a vertical axis of the main body, the support structures alternate between an opened position and a closed position by rotating about the vertical axis, the support structures having free ends defining a top surface and a bottom surface, at least one of the support structures having a projection extending outwardly from the top surface, and a plurality of feet disposed on the bottom surface, and a platform having an upper surface and a lower surface, the lower surface having elongated ridges that receive the top surface of the support structures when in the opened position, the platform further having an aperture formed therethrough from the lower surface to the upper surface to receive the projection on at least one of the support structures when in the opened position, the projection and the aperture each configured to ensure a correct orientation and placement of the platform on the main body, wherein the platform is stowed within a storage area defined by the support structures when the support structures are in the closed position, the platform having at least one clamp on the lower surface that is configured to interlock with the central post, wherein the platform has a sidewall disposed around a periphery of the platform, and wherein the upper surface and the sidewall of the platform has a recess formed therein for receiving at least one insert connector to secure the platform to another platform;

placing the two workstations adjacent to each other, wherein the recess of one of the workstations is adjacent to the recess of an other of the workstations; and inserting the insert connector into each of the recesses, whereby the two workstations are secured to each other and together form an enlarged work surface.

* * * * *